United States Patent [19]

Miyazaki

[11] 4,276,735

[45] Jul. 7, 1981

[54] APPARATUS FOR GUIDING WRAPPING PAPER IN COIN WRAPPING MACHINE

[75] Inventor: Yorizo Miyazaki, Tokyo, Japan

[73] Assignee: Laurel Bank Machine Co., Ltd., Tokyo, Japan

[21] Appl. No.: 92,105

[22] Filed: Nov. 7, 1979

[30] Foreign Application Priority Data

Nov. 8, 1978 [JP] Japan ..... 53-154386[U]

[51] Int. Cl.[3] ..... B65B 11/04

[52] U.S. Cl. ..... 53/212; 242/76

[58] Field of Search ..... 53/212; 83/447, 446, 83/240; 133/1 A, 8 A; 242/76; 226/198, 199

[56] References Cited

U.S. PATENT DOCUMENTS

| | | | |
|---|---|---|---|
| 49,110 | 8/1865 | Hutchinson | 83/447 |
| 3,798,873 | 3/1974 | Frahm | 53/212 |
| 3,878,666 | 4/1975 | Itoda | 53/212 |
| 3,899,864 | 8/1975 | Uchida | 53/212 |
| 3,905,176 | 9/1975 | Ushio | 53/212 |
| 4,038,806 | 8/1977 | Rothman | 53/212 X |
| 4,085,879 | 4/1978 | Nozuhiro | 53/212 |
| 4,089,151 | 5/1978 | Bergman | 53/212 X |

*Primary Examiner*—John Sipos

*Attorney, Agent, or Firm*—Fleit & Jacobson

[57] ABSTRACT

In a coin wrapping machine wherein stacks of coins of different diameters can be wrapped in a constant number of turns or layers of wrapping paper, having set of rollers for wrapping a stack of coins in a selected length of sheet of wrapping paper determined according to the diameter of the stack of coins, and a cutter capable of moving its position with respect to the rollers for cutting wrapping paper drawn out from a roll of wrapping paper into such selected length, there is provided a guiding apparatus which can guide the wrapping paper from the cutter to the rollers without fail. The guiding apparatus comprises a stationary guide member extending passing over the cutter to the rollers, and an extension type guide member extending along the stationary guide member. This extension type guide member comprises an elongated leaf spring which has its forward end fixed near the roller, and has the other end portion fixed with respect to the cutter and formed into a spiral which can resiliently wind and unwind following the movement of the cutter. The wrapping paper is guided by passing between these two guide members which make contact with the opposite surfaces of the wrapping paper, respectively. The guided wrapping paper can enter between the rollers regardless of self-turning tendency of the paper due to the roll.

8 Claims, 4 Drawing Figures

APPARATUS FOR GUIDING WRAPPING PAPER IN COIN WRAPPING MACHINE

BACKGROUND OF THE INVENTION

This invention relates to an apparatus for guiding wrapping stacks of coins with wrapping paper.

In a coin wrapping machine of the type designed to wrap stacks of coins of different diameters, as a rule, wrapping paper is drawn out from a roll of wrapping paper, is forwarded along a guide to a set of coin-wrapping rollers, which are adapted to wind wrapping paper around a stack of coins, so that the leading end portion of the wrapping paper may enter between the rollers, and is cut by a movable cutter into a selected length of sheet determined according to the diameter of a stack of coins to be wrapped. In the prior art coin wrapping machines of this type, however, there has been a problem that the leading end of wrapping paper forwarded along the guide has often failed in entering between the rollers, thus causing wrapping of coins to be uneffected. Such failure of wrapping paper in entering between the coinwrapping rollers is due to self-turning tendency of the wrapping paper which has been drawn out from the roll, and happens especially when the wrapping paper is cut into a large length of sheet, or when the roll of wrapping paper has been reduced in outer diameter.

SUMMARY OF THE INVENTION

The above-described problem in the prior art has been solved by the present invention.

It is therefore an object of the invention to provide an apparatus for guiding wrapping paper in a coin wrapping machine, which eliminates the above-described drawback of the prior art and can guide wrapping paper drawn out from a roll of wrapping paper so that the wrapping paper may enter between the coin-wrapping rollers without fail, regardless of cut length of wrapping paper, or regardless of outer diameter of the roll of wrapping paper.

Another object of the invention is to provide such an apparatus which is simple in construction.

In a coin wrapping machine which comprises a cutter capable of moving its position for cutting wrapping paper drawn out and forwarded from a roll of wrapping paper into a selected length of sheet, a set of coin-wrapping rollers for rotatably hold therebetween a stack of coins together with the forwarded wrapping paper thereby to wind the wrapping paper around the stack of coins, and a guide member for guiding the wrapping paper from the cutter to the coin-wrapping rollers by making contact with one surface of the wrapping paper, according to the invention, there is provided along the first mentioned guide member a second guide member of an extension type which has its forward end fixed near the coin-wrapping roller and has the other end portion made expansible/contractible following the movement of the cutter. This second guide member guides the wrapper paper in cooperation with the first guide member by making contact with the other surface thereof, so that the wrapping paper may enter between the coin-wrapping rollers without fail.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will now be described in detail with the reference to the accompanying drawings.

Figure 1:
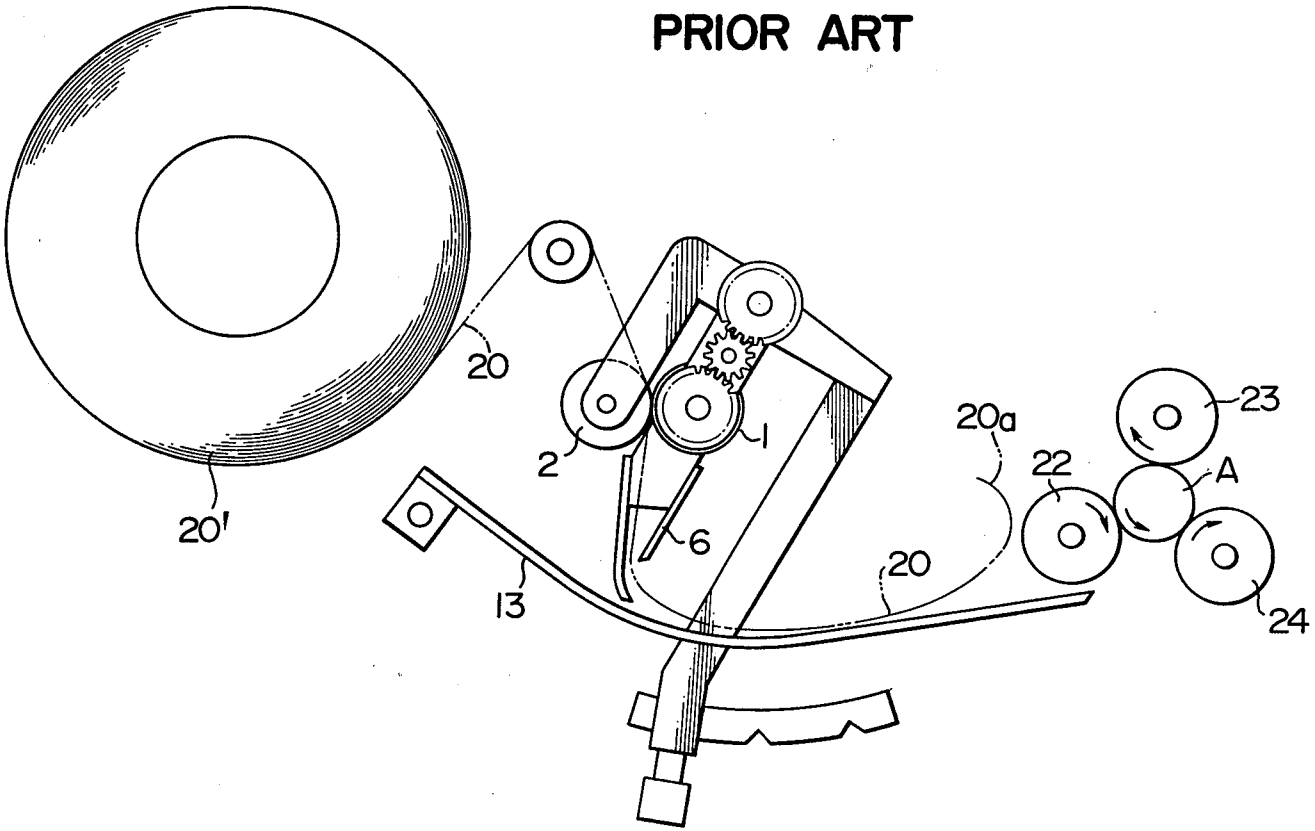
FIG. 1 PRIOR ART
FIG. 1 is a plan view showing a prior art apparatus.

For better understanding of the invention, first, description will be made about a typical example of the conventional art apparatus for guiding wrapping paper in a coin wrapping machine in connection with FIG. 1. As seen in FIG. 1, wrapping paper 20 is drawn out from a roll 20' of wrapping paper by a pair of paper-forwarding rollers 1, 2 and it forwarded passing over a movable cutter 6 onto a guide member 13. The wrapper paper 20 is further forwarded along the surface of the guide 13 toward a set of coin-wrapping rollers 22, 23, 24 so that the leading end portion of the wrapping paper may enter between the coin-wrapping rollers. The rollers 22, 23, 24 are adapted to rotatably hold therebetween a stack of coins A and to catch the leading end portion of the forwarded wrapping paper 20 between the stack of coins A and the roller 24, thereby to wind the wrapping paper 20 around the stack of coins A. The forwarded wrapping paper 20 is cut by the movable cutter 6 into a selected length of sheet determined according to the diameter of the stack of coins A. Thus, stacks of coins of different diameters can be wrapped in a constant number of turns or layers of wrapping paper by moving the cutter 6 to a suitable position with respect to the coin-wrapping rollers, that is, by changing the cut length of wrapping paper according to the diameter of a stack of coins to be wrapped. The roll 20' of wrapping paper includes a core of relatively small diameter around which the wrapping paper 20 is wound in large number of turns or layers. Accordingly, the roll 20', as initially set in the coin wrapping machine, has a relatively large outer diameter. The wrapping paper 20, which has just been drawn out from the circular roll 20' and forwarded onto the guide 13, has more or less a self-turning tendency due to the curvature in the roll 20'. As a result, especially when the cut length of the wrapping paper 20 is large, or when a large amount of paper of the roll 20' has been consumed and the wrapping paper 20 is drawn out from near the core of the roll 20', the leading end portion **20*a* of the wrapping paper 20 may often largely turn up away from the guide 13, as shown in FIG. 1**, and fails in entering between the wrapping rollers, causing wrapping of coins to be uneffected.

The above-described problem in the prior art has been effectively solved by the present invention with a simple construction. The invention will now be described in detail in connection with a preferred embodiment thereof, reference being made to FIGS. 2 to 4 wherein similar parts as those in FIG. 1 will be indicated by the like numerals.

Figure 2:
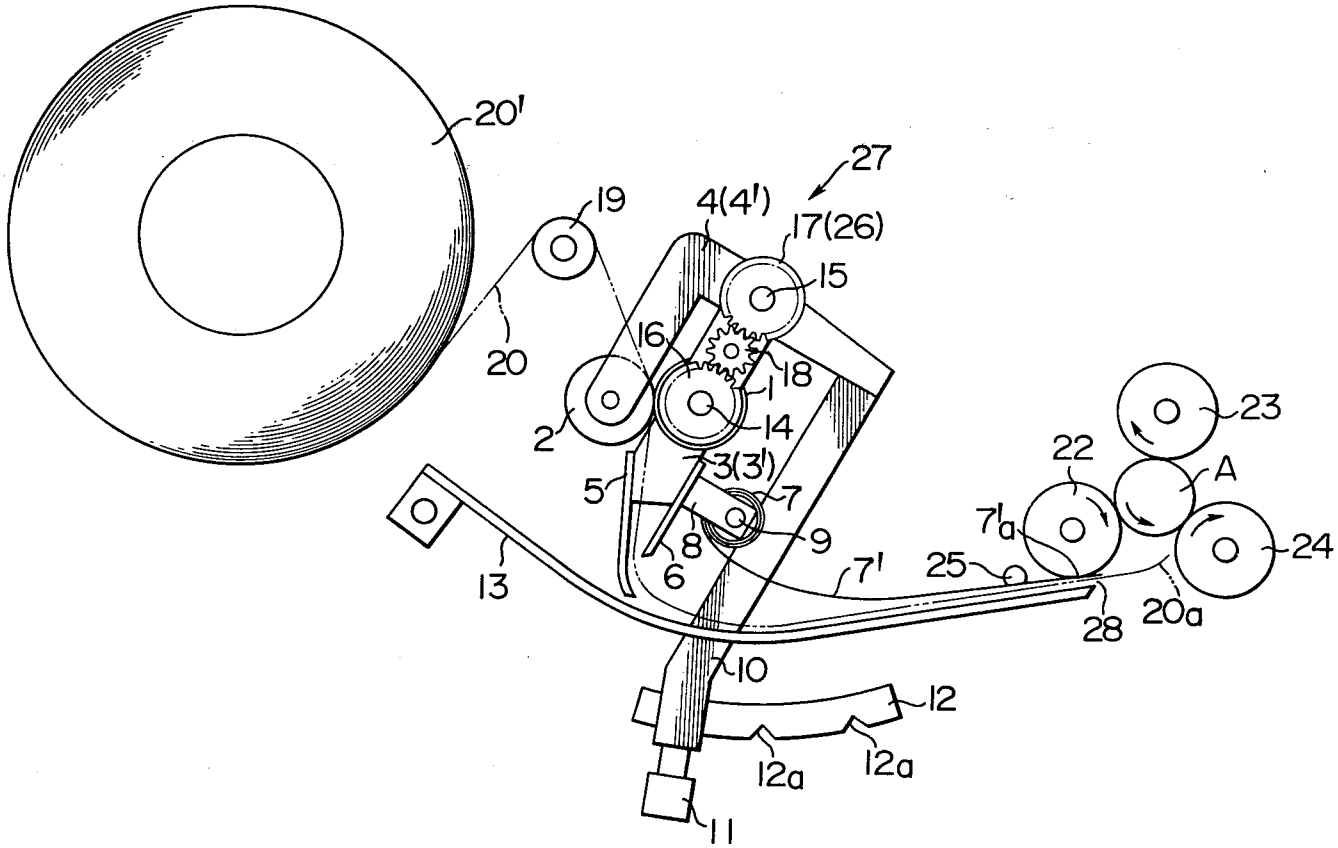
FIG. 2 is a plan view showing an embodiment of the invention, with the cutter being moved in the direction of departing away from the coin-wrapping rollers.
Figure 3:
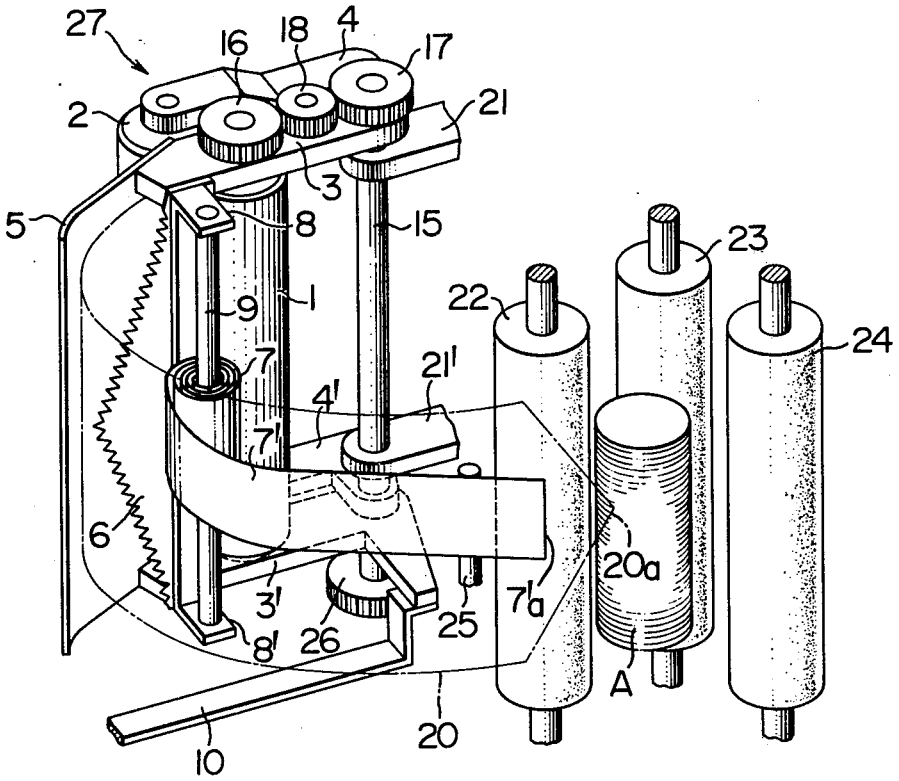
FIG. 3 is a perspective view showing in detail the essential portion of the embodiment of FIG. 2.

Referring to FIGS. 2 and 3, reference numeral 27 generally indicates a device which is adapted to forward and cut wrapping paper. The device 27 has a vertical shaft 15 supported for rotation by a pair of support member 21, 21' which are secured to the frame of a coin wrapping machine. Supported for rotation on the upper and lower end portions of the shaft 15 are a pair of horizontal swing arms 3, 3' which rotatably support on their free end portions a vertical paper-forwarding roller 1, and also are a pair of horizontal swing arms 4, 4' which rotatably support on their free ends another vertical paper-forwarding roller 2 which is urged by suitable means into contact with the roller 1. Fixed on the lower end of the shaft 15 is a gear 26 which is driven by a suitable motor (not shown). Fixed on the upper end of the shaft 15 is a gear 17 for transmitting rotary motion of the shaft 15, which is driven through the gear 26, via an intermediate gear 18 to a gear 16 which is fixed on the upper end of a rotating shaft 14 of the paper-forwarding roller 1 thereby to rotate the roller 1. The roller 2 is driven by the roller 1 through frictional engagement therebetween. Secured on side edges of the free end portions of the swing arms 3, 3' are a guide plate 5 and a cutter 6 having its triangular cutting edge disposed in opposition to the surface of the guide plate 5. From the other side edges of the free end portions of the swing arms 3, 3' project a pair of support members 8, 8' which rotatably support a vertical shaft 9 which is disposed near the base of the triangular cutter 6. The shaft 9 is provided around its intermediate portion with a constant-loaded spiral leaf spring member 7 to be described later. From the base portion of the lower swing arm 3' extends a horizontal lever 10 which has on its top a knob 11. Thus, movement of the lever 10 to the right or left causes the device 27 including the above-described various parts to be rotated about the shaft 15 to the right or left.

An arcuate plate 12 having a plurality of notches **12*a* formed in its outer side edge is provided in a manner that the top of the lever 10 may move along the plate 12 and the knob 11 can come into engagement with a desired one of the notches 12*a* for locking the lever 10** thereat.

There is provided an elongated guide member 13 which extends horizontally passing over the top of the guide plate 5 with a gap therebetween. Provided near the forward end of the guide member 13 are a set of vertical coin-wrapping rollers 22, 23, and 24 which are arranged at generally equal angular intervals in an adjustable relationship with respect to one another. The rollers 22, 23 and 24 rotate about their central axes in the directions shown by the arrows thereby to rotatably hold therebetween a stack of coins A to be wrapped.

The constant-loaded spiral leaf spring member 7 mentioned hereinabove has its inner end secured to the shaft 9, and has its outer end portion 7' extended along the guide member 13 up to a point close to the peripheral surface of the coin-wrapping roller 22 which is near the forward end of the guide member 13. The extended portion 7' is secured at a point near its forward end to a fixed support rod 25. Thus, the extended portion 7' of the leaf spring member 7 serves as a second guide member which cooperates with the first mentioned guide member 13 to form therebetween a passageway for wrapping paper 20, the forward ends of the members 13 and 7' forming therebetween an outlet 28 for the wrapping paper.

In operation, wrapper paper 20 is drawn out in succession, passing around a guide roller 19, by being held between the rotating paper-forwarding rollers 1 and 2 from a roll 20' of wrapping paper which is rotatably set in the coin wrapping machine in a known manner, and is forwarded along the guide plate 5 and passing over the cutter 6 into the passageway between the guide members 13 and 7'. This wrapping paper 20 is forwarded until the leading end portion **20*a* thereof protrudes from the outlet 28 and is caught between the coin-wrapping roller 24 and a stack of coins A which is held among and rotated by the rotating coin-wrapping rollers 22, 23, 24. Upon this, the wrapping paper 20 is rapidly pulled forwardly by the coin-wrapping roller and the stack of coins, and accordingly the forwarded wrapper paper 20 is pressed against and cut by the cutter 6 into a selected length of sheet determined by the position of the cutter 6. This cut sheet is wound around the stack of coins A by the coin-wrapping rollers 22, 23, 24**, and then the upper and lower margins of the sheet are crimped inwardly, by means of the conventional crimping claws, to complete wrapping.

Figure 4:
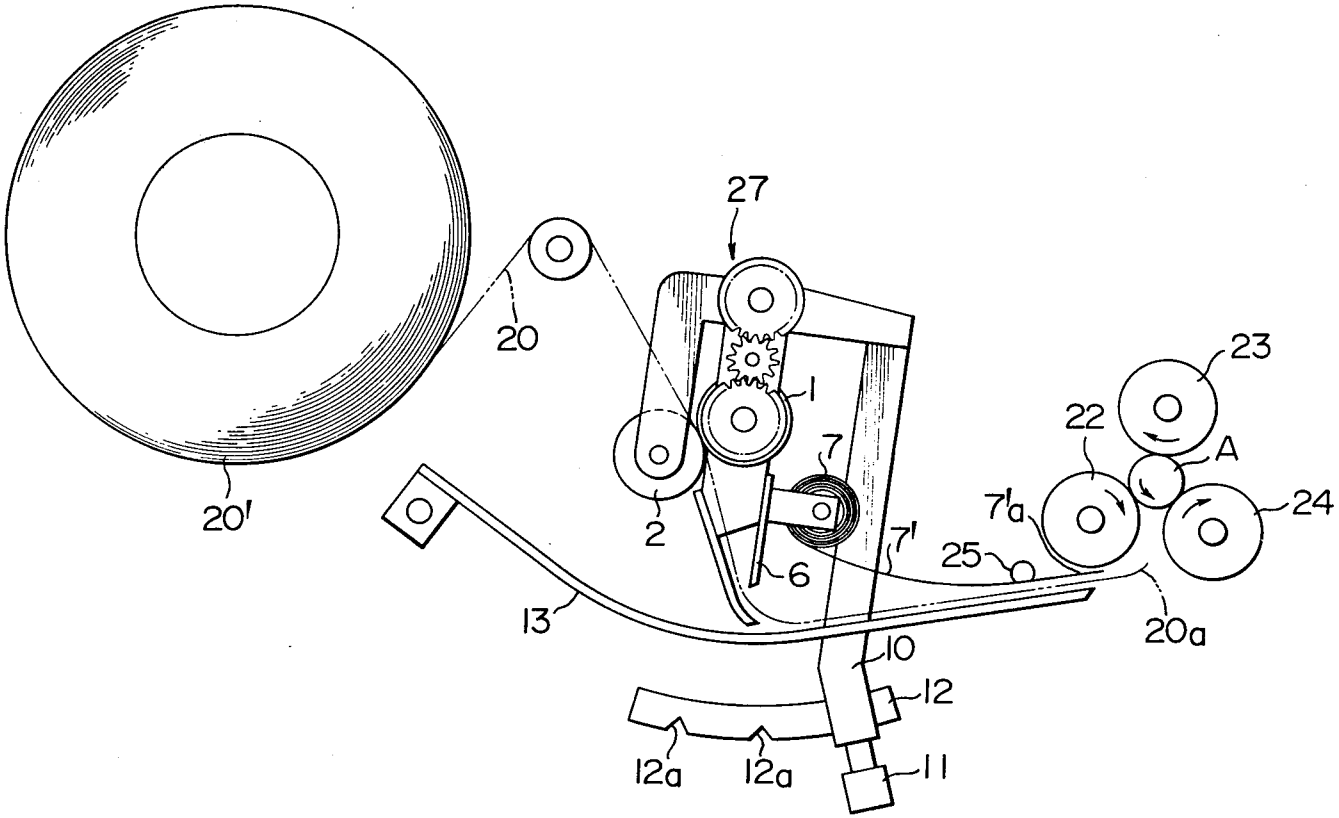
FIG. 4 is a plan view similar to FIG. 2, with the cutter being moved in the direction of coming near to the coin-wrapping rollers.

FIG. 2 shows a case of wrapping a stack of coins A of a large diameter, wherein the lever 10 is moved to the left-hand position on the lock plate 12 to move the device 27 leftward for moving the cutter 6 away from the coin-wrapping roller, thereby to cut the wrapper paper 20 into a large length of sheet for winding the stack of coins A in a predetermined number of turns or layers of the wrapping paper. In case or wrapping a stack of coins A of a small diameter, the lever 10 is moved to the right-hand position on the lock plate 12 to move the cutter 6 toward the coin-wrapping roller, as shown in FIG. 4, thereby to cut the wrapping paper 20 into a short length of sheet for winding the stack of coins A in the same number of turns or layers as in the first mentioned case.

As the lever 10 and accordingly the cutter 6 move for changing cut length of the wrapping paper, the second guide member 7', with its forward end portion fixed near the coin-wrapping roller, can expand or contract its extended length following the movement of the cutter 6 by virtue of the resilient winding/unwinding action of the spiral end portion of the member 7 which is resiliently wound around the shaft 9, thus there being no inconvenience to the wrapping paper 20 to be guided to the coin-wrapping roller. Of course, the lever 10 can be moved to and locked at any desired position or notch **12*a* on the lock plate 12** to cut wrapping paper into any selected length of sheet.

As will be apparent from the above, according to the invention, in a coin wrapping machine having a cutter capable of moving for changing cut length of wrapping paper which is drawn out from a roll of wrapping paper and forwarded to coin-wrapping rollers, the wrapping paper can be guided to enter between the coin-wrapping rollers without fail, regardless of cut length of the wrapping paper or of outer diameter of the roll of wrapping paper.

While the invention has been described in connection with the preferred embodiment thereof, it should be understood that various changes and modifications can be made by those skilled in the art without departing from the spirit and the scope of the invention.

I claim:

1. In a coin wrapping machine including a set of rollers for wrapping a stack of coins in a selected length of sheet of wrapping paper, means for drawing the sheet from a roll of wrapping paper and for forwarding the sheet to the rollers, a cutter for cutting the forwarded wrapping paper into a selected length of sheet, and means for movably mounting the cutter so that an initial position of the cutter is adjustable with respect to the rollers, an apparatus for guiding the wrapping paper from the cutter to the rollers comprising: a first guide member extending between a point near said cutter and a point near said rollers for guiding the wrapping paper from said cutter to said rollers; a second guide member comprising a single extensible and contractible member extending along and spaced from said first guide member for guiding, in cooperation with said first guide member, the wrapping paper, said second guide member having one end portion thereof fixed near one of said set of rollers; and means for mounting the other end portion of said second guide member on said means for movably mounting the cutter that the location of the other end portion is changed when the initial position of said cutter is changed whereby the other end portion of said second guide member is closely spaced from the cutter in all positions of the cutter.

2. An apparatus according to claim 1, wherein said other end portion of the second guide member comprises an expansible and contractible resilient spiral.

3. An apparatus according to claim 1, wherein said second guide member comprises an elongated leaf spring having one end portion thereof extended along said first guide member and having the other end portion resiliently wound into a spiral.

4. An apparatus according to claim 1, wherein said second guide member is so arranged that it may make contact with a surface of wrapping paper which has a tendency to be concaved due to curvature in the roll of wrapping paper.

5. A coin wrapping machine comprising a set of rollers for wrapping a stack of coins in a selected length of sheet of wrapping paper; means for drawing the sheet from a roll of wrapping paper and for forwarding the sheet to the rollers; cutter means including a cutter for cutting the forwarded wrapping paper into a selected length of sheet; means for adjustably mounting the cutter on the machine so that an initial position of the cutter is movable with respect to the set of rollers; first guide means extending between a point near said cutter and a point near said rollers for guiding the wrapping paper from said cutter to said rollers; and second guide means comprising a single extensible and contractible member extending along and spaced from said first guide means for guiding, in cooperation with said first guide means, the wrapping paper, said second guide means having one end portion thereof fixed near one of said set of rollers and having the other end portion mounted on said means for adjustably mounting so that the location of the other end portion is changed when the initial position of said cutter is changed.

6. An apparatus according to claim 5, wherein said other end portion of the second guide means comprises an expansible and contractible resilient spiral.

7. An apparatus according to claim 5, wherein said second guide means comprises an elongated leaf spring having one end portion thereof extended along said first guide means and having the other end portion resiliently wound into a spiral.

8. An apparatus according to claim 5, wherein said second guide means is so arranged that it may make contact with a surface of wrapping paper which has a tendency to be concaved due to curvature in the roll of wrapping paper.

* * * * *